US005970965A

United States Patent [19]

Bentel et al.

[11] Patent Number: 5,970,965

[45] Date of Patent: Oct. 26, 1999

[54] INDUCTIVE COIL IGNITION SYSTEM FOR AN ENGINE

[75] Inventors: Ulrich Bentel, Wiernsheim; Helmut Schmied, Marbach; Thomas Capouschek, Münchingen, all of Germany

[73] Assignee: Robert B osch GmbH, Stuttgart, Germany

[21] Appl. No.: 08/986,949

[22] Filed: Dec. 8, 1997

[30] Foreign Application Priority Data

Dec. 16, 1996 [DE] Germany ..... 196 52 267

[51] Int. Cl.[6] ..... F02P 11/06

[52] U.S. Cl. ..... 123/651; 123/656; 324/380; 324/388

[58] Field of Search ..... 123/406.14, 481, 123/630, 650, 651, 652, 655, 656, 643; 324/378, 380, 388, 399

[56] References Cited

U.S. PATENT DOCUMENTS

| | | | |
|---|---|---|---|
| 4,270,509 | 6/1981 | Tharman | 123/652 X |
| 5,337,716 | 8/1994 | Fukui et al. | 123/630 X |
| 5,400,760 | 3/1995 | Miyata et al. | 123/630 |
| 5,444,375 | 8/1995 | Ohsawa et al. | 324/380 |
| 5,814,994 | 9/1998 | Hohner et al. | 324/380 |

*Primary Examiner*—Tony M. Argenbright
*Attorney, Agent, or Firm*—Kenyon & Kenyon

[57] ABSTRACT

An inductive coil ignition system for an engine, having at least one ignition coil which includes a primary winding fed from a voltage source and having two terminals, and a secondary winding also having two terminals. A switching apparatus is arranged parallel to the primary winding and connects the two terminals of the primary winding as a function of a control signal. An activation circuit generates the control signal.

14 Claims, 2 Drawing Sheets

INDUCTIVE COIL IGNITION SYSTEM FOR AN ENGINE

FIELD OF THE INVENTION

The present invention relates to an inductive coil ignition system for an engine, having at least one ignition coil which includes a primary winding fed from a voltage source and having two terminals, and a secondary winding also having two terminals.

BACKGROUND OF THE INVENTION

Inductive coil ignition systems for engines, in particular motor vehicle engines, are known. The ignition coil used in such systems has a primary winding which is periodically acted upon by a primary current. This current serves to build up in the coil a magnetic field which is intended to serve as an energy reservoir. At the desired moment of ignition, the primary current is interrupted. The energy stored in the magnetic field then produces a steep rise in the voltage at the secondary winding, resulting in a spark discharge in the spark plug and a correspondingly steep rise in the secondary current. The magnetic energy stored in the coil flows out continuously into the sparks as electrical energy.

In modern ignition systems, there is now a requirement to measure combustion-related parameters as accurately as possible, and to optimize ignition on the basis of them. One method, known from the existing art, for determining such combustion parameters is represented by the ionization current measurement method.

Since the ionization current measurement method requires an extinguished ignition spark, it cannot be used in known ignition systems in which the secondary current decays slowly. Other, more complex measurement systems are instead required in order to detect, for example, incipient knocking in an engine.

SUMMARY OF THE INVENTION

The inductive coil ignition system according to the present invention has the advantage that it allows the use of the ionization current measurement method, so that an economical overall result can be achieved. Because a switching apparatus arranged parallel to the primary winding electrically connects the two terminals of the primary winding at a point in time that can be predetermined, the magnetic energy in the coil is dissipated through the primary winding so that the secondary current drops abruptly. The ignition spark is extinguished as a result of this current drop, so that an ionization current measurement is possible immediately thereafter. The switching element arranged parallel to the primary winding is activated via a control input by a control signal generated in a special activation circuit.

DETAILED DESCRIPTION

Figure 1:
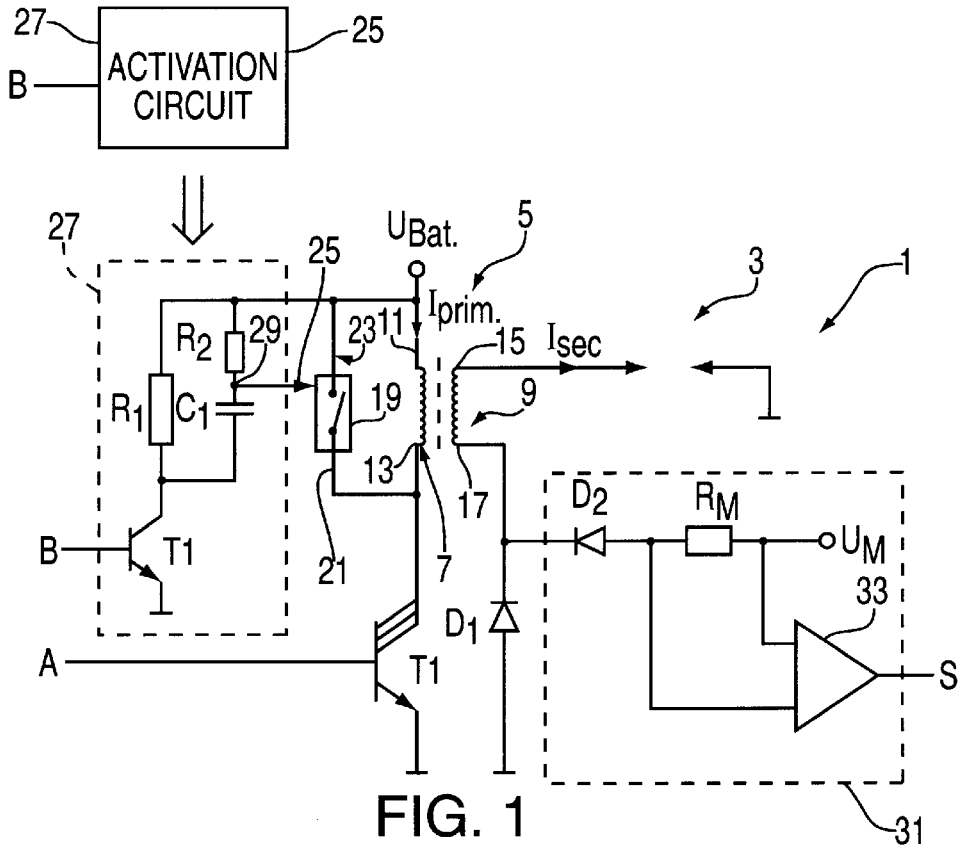
FIG. 1 shows a circuit diagram of an inductive coil ignition system having an ionization current measurement apparatus.

FIG. 1 shows an inductive coil ignition system 1 that serves to activate a spark plug 3 which is associated, for example, with a cylinder of a motor vehicle engine. An essential component of a coil ignition system of this kind is a coil 5 which has a primary winding 7 and a secondary winding 9. One connection side 11 of primary winding 7 is connected to the positive pole of a DC voltage source, preferably a battery, the other terminal 13 to the collector of a transistor T whose emitter is connected to ground. Transistor T is preferably a triple Darlington transistor. An ignition signal A is applied to the base of transistor T.

On the secondary side of coil 5, a first terminal 15 of secondary winding 9 is connected to one pole of the spark plug, the other pole of which is connected to ground.

Connected to the second terminal 17 of secondary winding 9 is a cathode of a diode D1 whose anode is connected to ground.

Provided parallel to primary winding 7 is a switching element 19, whose one terminal 21 is connected to terminal 13, and whose second terminal 23 is connected to the first terminal 11 of the primary winding. An activation signal generated by an activation circuit 27 is conveyed to control input 25 of switching element 19.

Activation circuit 27 is controlled via a control signal B.

Associated with the secondary side of coil 5 is an ionization current measurement apparatus 31 which, after the ignition spark is extinguished, measures the ionization current flowing through the plug. Based on this reading, it is possible to draw conclusions as to how combustion is proceeding. The ionization current measurement apparatus includes a series circuit made up of a measurement resistor $R_M$ and a diode D2, the anode of the diode being connected to the resistor. The other terminal of measurement resistor $R_M$ is connected to a measurement voltage $U_M$, while the cathode of diode D2 is electrically connected to second terminal 17 of secondary winding 9. The voltage drop at measurement resistor $R_M$ is conveyed to a measurement amplifier, preferably an operational amplifier, which generates a difference signals and conveys it to an analysis device. It is important, for utilization of the ionization current measurement apparatus, that the secondary current generated by the magnetic field of the coil has decreased to zero, and that the ignition spark has thus been extinguished. An ionization current measurement is not possible as long as an ignition spark exists.

Figure 2:
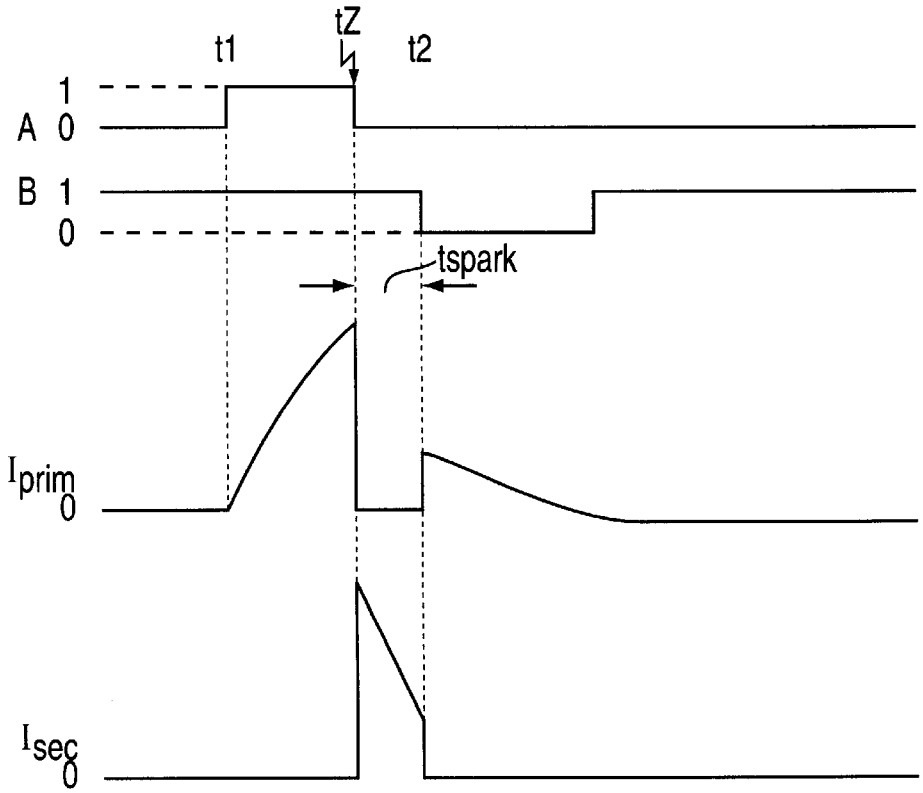
FIG. 2 shows a diagram of the voltage and current profiles.

The operation of inductive coil ignition system 1 will now be explained with reference to the voltage and current diagrams in FIG. 2.

As in the case of the inductive coil ignition systems known from the existing art, the ignition signal A is set at a time t1 to a voltage level "1" (for example, 5 V), with the consequence that transistor T becomes conductive. A primary current $I_{prim}$ thus flows from the battery voltage $U_{bat}$ via primary winding 7 and the collector-emitter connection of transistor T to ground. Because of the inductivity of coil 5, the current $I_{prim}$ rises exponentially. This primary current $I_{prim}$ serves to build up a magnetic field in coil 5 that is intended to supply the energy necessary for ignition. At a desired ignition time $t_z$, ignition signal A is set to a potential "0" (for example, 0 V). Transistor T falls back into the nonconducting state, with the result that the primary current can no longer dissipate to ground. As is clearly evident from the diagram, it drops back to a value of 0.

This current drop in the primary winding causes induction of a very high voltage in secondary winding 9. As soon as the voltage is sufficient, an ignition spark occurs in spark plug 3, simultaneously with a steep rise in the secondary current $I_{sec}$, as shown in FIG. 2. The magnetic energy stored in the coil is then converted into electrical energy, so that a secondary current continues to flow through the plug to ground, the magnitude of the current decreasing over time.

After a definable time period $t_{spark}$, at a time t2 the control signal B, which is at a "1" level, is set to a "0" level. As a result, activation circuit 27 switches switching element 19, via control input 25, into the conductive state. An electrical connection is thus created between the two terminals 11, 13 of primary winding 7, so that a further dissipation of the magnetic energy stored in the coil by means of the primary current $I_{prim}$ occurs. It is evident from the diagram in FIG. 2 that the primary current $I_{prim}$ has risen considerably at time t2, and decays slowly over time until the stored magnetic energy has decreased to a value of 0.

Simultaneously with the flow of a primary current $I_{prim}$ at time t2, the secondary current $I_{prim}$ drops to a value of 0.

The result is therefore that after only a short duration $t_{spark}$, the secondary current has dropped to 0 and an ionization current measurement is thus possible. For this purpose, shortly after time t2 a measurement voltage $U_M$ is switched into the ionization current measurement apparatus, generating a current which flows through measurement resistor $R_M$, diode D2, secondary winding 9, and spark plug 3. The magnitude of this ionization current depends in particular on the combustion conditions inside the cylinder associated with plug 3. The value of the current itself can be determined by tapping the voltage drop which results at measurement resistor $R_M$.

On the basis of the measured ionization current, it is possible, for example, to assess whether combustion has occurred too early, with the resulting danger of knocking. It is also possible to determine whether combustion has occurred at all. The measured values are then incorporated, for example, into a redetermination of the ignition angle and a diagnosis of the ignition system.

Figure 3:
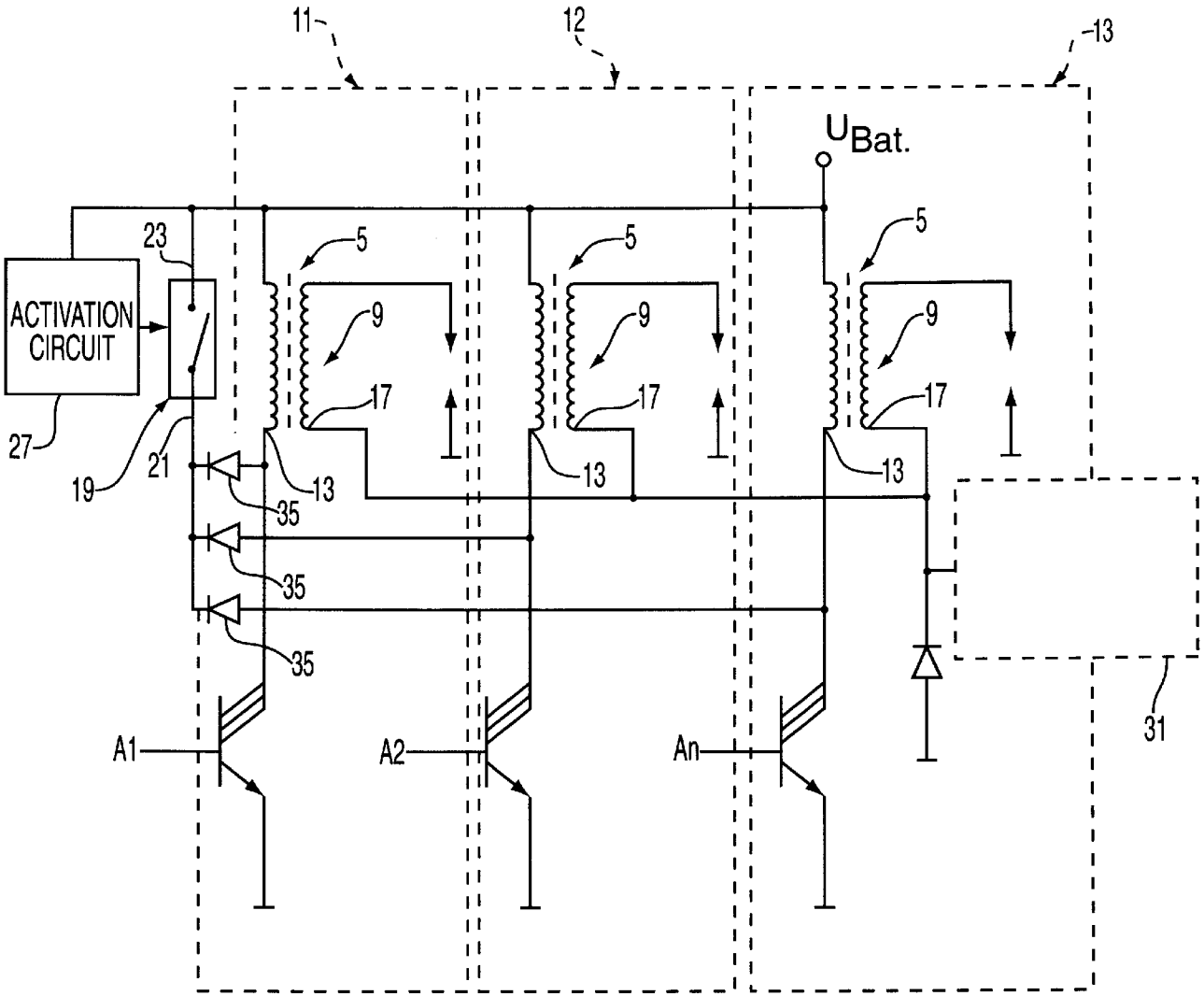
FIG. 3 shows a second exemplary embodiment of an inductive coil ignition system.

FIG. 3 depicts an ignition system that is constructed from multiple ignition coils. Systems of this kind are used in multiple-cylinder engines, one ignition coil being associated, for example, with each cylinder.

Because the individual systems 1.1, 1.2, and 1.3 surrounded by dashed lines correspond in their configuration and manner of operation to the ignition system as shown in FIG. 1, parts identified by the same reference characters will not be described again.

It is significant, however, that for the three ignition coil systems 1.1 to 1.3 shown in FIG. 3, only one activation circuit 27 with one switching element 19 and one ionization current measurement apparatus 31 is provided. Terminals 13 of the three coils 5 are joined, each via a diode 35, to terminal 21 of the switching element, the anode of each diode 35 being present at terminal 13. This configuration allows a very economical implementation of an inductive coil ignition system even in multiple-cylinder engines, since only one switching element and one activation circuit 27 are necessary.

Ionization current measurement apparatus 31 is connected to all terminals 17 of secondary windings 9 of each coil ignition system 1.1 to 1.3, so that structural savings are realized here as well.

It is of course also possible to construct coil ignition systems which have more than the three individual coils shown in FIG. 3. The coils themselves can be configured as single-spark or double-spark coils.

What is claimed is:

1. An inductive coil ignition system for an engine, comprising:

at least one ignition coil including a primary winding and a secondary winding, the primary winding being coupled to a voltage source, the primary winding having two terminals;

an activation circuit for generating a control signal; and a switching apparatus arranged parallel to the primary winding, the switching apparatus connecting the two terminals of the primary winding as a function of the control signal, wherein the switching apparatus is closed at a time point at which an ignition spark is extinguished.

2. The ignition system according to claim 1, wherein the secondary winding has two terminals.

3. The ignition system according to claim 1, wherein the activation circuit has for the switching apparatus a control input for receiving a trigger signal.

4. The ignition system according to claim 1, further comprising a Darlington transistor for connecting the primary winding to the voltage source.

5. The ignition system according to claim 1, further comprising a spark plug connecting a first terminal of the secondary winding to a ground, and a diode connecting a second terminal of the secondary winding to the ground.

6. The ignition system according to claim 5, further comprising an ionization current measurement apparatus coupled to the second terminal of the secondary winding.

7. The ignition system according to claim 1, wherein the at least one ignition coil includes a single-spark coil.

8. The ignition system according to claim 1, wherein the at least one ignition coil includes a double-spark coil.

9. The ignition system according to claim 1, wherein the switching apparatus remains closed during an entire time that ionization current is measured.

10. An inductive coil ignition system for an engine, comprising:

at least one ignition coil including a primary winding and a secondary winding the primary winding being coupled to a voltage source, the primary winding having two terminals;

an activation circuit for generating a control signal;

a switching apparatus arranged parallel to the primary winding, the switching apparatus connecting the two terminals of the primary winding as a function of the control signal;

a spark plug connecting a first terminal of the secondary winding to a ground, and a diode connecting a second terminal of the secondary winding to the ground; and an ionization current measurement apparatus coupled to the second terminal of the secondary winding, the ionization current measurement apparatus including a series circuit, the series circuit including a diode and a current measurement resistor, a first end of the series circuit being coupled to the secondary winding, a second end of the series circuit being coupled to a measurement voltage.

11. The ignition system according to claim 10, further comprising a measurement amplifier for tapping a voltage drop at the current measurement resistor.

12. An inductive coil ignition system for an engine, comprising:

at least one ignition coil including a primary winding and a secondary winding, the primary winding being coupled to a voltage source, the primary winding having two terminals;

an activation circuit for generating a control signal; and a switching apparatus arranged parallel to the primary winding, the switching apparatus connecting the two terminals of the primary winding as a function of the control signal;

wherein the engine includes a plurality of cylinders, the at least one ignition coil includes a plurality of ignition coils corresponding to the plurality of cylinders, and the switching apparatus is associated with each of the ignition coils.

13. The ignition system according to claim 12, further comprising a diode coupling a second terminal of each primary winding to a terminal of the switching apparatus.

14. An inductive coil ignition system for an engine, comprising:

at least one ignition coil including a primary winding and a secondary winding, the primary winding being coupled to a voltage source, the primary winding having two terminals;

an activation circuit for generating a control signal;

a switching apparatus arranged parallel to the primary winding, the switching apparatus connecting the two terminals of the primary winding as a function of the control signal; and an ionization measurement apparatus coupled to the secondary winding, the ionization measurement apparatus measuring an ionization current, wherein the switching apparatus remains closed during an entire time that the ionization measurement apparatus measures the ionization current.

* * * * *